US005877582A

United States Patent [19]

Nishimura

[11] Patent Number: 5,877,582

[45] Date of Patent: Mar. 2, 1999

[54] METHOD AND APPARATUS FOR COOLING WINDOW FOILS OF ELECTRON BEAM ACCELERATOR

[75] Inventor: Tatsuya Nishimura, Kanagawa-ken, Japan

[73] Assignee: Ebara Corporation, Tokyo, Japan

[21] Appl. No.: 732,114

[22] Filed: Oct. 15, 1996

[30] Foreign Application Priority Data

Oct. 17, 1995 [JP] Japan ..... 7-293300
Oct. 8, 1996 [JP] Japan ..... 8-267311

[51] Int. Cl.[6] ..... H01J 7/26; H01J 61/52; H01J 1/02; H01J 7/24

[52] U.S. Cl. ..... 313/35; 313/420; 313/40; 313/42

[58] Field of Search ..... 313/35, 40, 42, 313/45, 413, 415, 417, 420

[56] References Cited

FOREIGN PATENT DOCUMENTS 07094135 4/1995 European Pat. Off. .
07094136 4/1995 European Pat. Off. .
07094137 4/1995 European Pat. Off. .
60-10600 3/1985 Japan .
4-299001 3/1992 Japan .
6-51900 7/1994 Japan .
8166497 6/1996 Japan .

OTHER PUBLICATIONS

European Patent Office Comminication with attached European Search Report for Eurpean Patent Application No. 96116681.8 dated Jan. 23, 1997.

*Primary Examiner*—Sandra O'Shea
*Assistant Examiner*—Mark Haynes
*Attorney, Agent, or Firm*—Armstrong, Westerman, Hattori, McLeland & Naughton

[57] ABSTRACT

A method and apparatus for cooling window foils for extracting electron beams from a scanning type electron beam accelerator, the accelerator includes a primary window foil of double window type and a secondary window foil, the method and the apparatus are characterized by blowing cooling gasses against an electron beam scanning surface from both sides thereof to cool the primary window foil then reversing the flow of the cooling gasses at the center of the primary window foil, and circulating the cooling gasses by sucking the cooling gasses from both sides of the electron beam scanning surface to thereby simultaneously cool the secondary window foil.

9 Claims, 5 Drawing Sheets

Flg. 5 PRIOR ART

METHOD AND APPARATUS FOR COOLING WINDOW FOILS OF ELECTRON BEAM ACCELERATOR

BACKGROUND OF THE INVENTION

1. Field of the Art

The present invention relates to a method and an apparatus for cooling window foils in an electron beam accelerator, and more particularly, to a method and an apparatus for cooling window foils in a scanning type electron beam accelerator containing double windows used to treat a boiler exhaust gas and the like.

2. Prior Arts

Electron beam accelerators are widely used in various industrial fields. Among them, in electron beam accelerators used for treating a subject to be irradiated in the atmosphere such as a boiler exhaust gas, electron beams accelerated to a high speed in vacuum of the accelerator must be extracted into the atmosphere. For this purpose, a window formed of a pure titanium or titanium alloy foil 30 to 50 microns thick is utilized. Further, when the density of an electron current is increased to enhance the irradiation effect, an accelerator with an electron current of several hundreds of milliamperes must be used.

In this kind of accelerator, part of the energy is absorbed when electron beams pass through a window foil whereby heating results and the foil may be damaged. To prevent this, a window for extracting the electron beam is formed in a rectangular shape and the electron beam is scanned along a long axis of the rectangular shaped window to prevent the electron beam from being concentrated in one position on the foil. At the same time, a nitrogen gas or the like is blown against the window foil to cool it and prevent unwarranted temperature rise.

Further, when the electron beam has a current value as large as several hundred milliamperes, the electron beam is further scanned along the short axis of the rectangular shaped window to increase the travelling distance thereof thereby increasing the cross sectional area of the rectangular shaped window. However, when the cross sectional area of the window portion is increased, since the foil is used to isolate a vacuum in which the electron beam is accelerated from the atmosphere, a force acting on the foil increases, thereby causing the foil to be pulled into the vacuum side excessively. To prevent this, a support is provided at the center of the window foil to hold the foil. Consequently, the window portion is divided into two regions. Such a structure is known as a double window.

Further, double foils including a primary foil and a secondary foil are used in the window to protect the window foil in processes such as treating a boiler exhaust gas in which sulfuric acid and nitric acid could be produced.

FIG. 3 shows the arrangement of the conventional electron beam accelerator, FIG. 4 shows the structure of the double windows and FIG. 5 shows a conventional window foil cooling mechanism (a view in a short axis direction of the window). In the figures, the reference numeral 1 denotes a high voltage power supply, 2 a high voltage cable, 3 an accelerating tube, 4 a scanning coil, 5 a scanning tube, 6 a window foil mounting flange, 7 an exhaust gas duct, 8 an electron beam, 9 an exhaust gas flow, 10 a first window of primary window foil, 11 a second window of primary window foil and 12 a locus of scanned electron beam. In the conventional electron beam accelerator using the double windows or the double window foils, the primary foil 14, 15 and the secondary foil 16 are cooled by blowing gasses from respective sides of the rectangular window along the long axis direction thereof confronting with each other. In this case, since both the double windows of the primary foil must be simultaneously cooled, a central support 13 is retracted from the end surface of a window mounting flange 25 to the vacuum side so as to cause cooling gasses 19, 20 to impinge on both the first window 14 and the second window 15 of the primary window foil.

The cooling gasses 19, 20 are supplied from corresponding blowing out slits 17, 18 for cooling the primary window and the secondary window, respectively.

When the distance of the window foil is increased in the short axis direction or width thereof to increase the scanning distance of the electron beam in the conventional cooling method, the second window 15 of the primary window foil may be excessively heated and damaged because the cooling gasses do not sufficiently reach the second window of the primary window foil. An increase in the amount of the cooling gasses to prevent this problem requires a blower having a large capacity and is economically unrealistic.

Further, in a conventional both-side-blowing-out cooling method wherein a gas reversing mechanism 29 is mounted to the central support 13 disposed in a vacuum side from the atmospheric side as shown in FIG. 6, since a window foil is sandwiched between the central support 13 and reversing mechanism 29, the reversing mechanism cannot be directly mounted on the central support at the portion of the window foil. Thus, since the reversing mechanism 29 is long (e.g. 1–3M) and is separately mounted on the central support at the short axis portion of the window, a reversing mechanism 29 is heated and expanded resulting in deformation by a dispersed electron beam impinging thereon while an accelerator is in operation, so that a gap is formed between the central support and the reversing mechanism. As a result, the gap may allow gas to leak, and cooling gasses may not be able to be reversed smoothly, the gap may clog with dust, the flow is disturbed and the foil may be damaged in some cases. In addition, the cooling mechanism shown in FIG. 6 is not used in the application in which a secondary window foil is used.

Therefore, an object of the present invention is to provide a method and apparatus for cooling window foils which are capable of sufficiently cooling window foils even if the length of a window portion is increased in the short axis direction thereof to increase the travelling distance of electron beams.

Another object of the invention is to provide a method and apparatus for cooling window foils as described above and which is further capable of avoiding deformation of the reversing mechanism caused by impingement of the dispersed electron beam and thereby maintains smooth reversal of the flow of the cooling gasses.

Further object of the invention is to provide a method and apparatus for cooling window foils as described above and which is further capable of cooling both the primary window foil and the secondary window foil simultaneously without the need for large equipment.

SUMMARY OF THE INVENTION

In order to accomplish the objects stated above, according to a first aspect of the invention, there is provided a method for cooling window foils for extracting electron beams from a scanning type electron beam accelerator including a scanning tube, a primary window foil of a double window type attached to the outlet of said scanning tube, and a secondary window foil provided on the atmospheric side of said primary window foil, characterized by comprising the steps of blowing cooling gasses against an electron beam scanning surface from both sides thereof to cool said primary window foil, reversing the flow of said cooling gasses at the center of said primary window foil, and circulating said cooling gasses by sucking the cooling gasses from both sides of said electron beam scanning surface to thereby simultaneously cool said secondary window foil.

According to an another aspect of the invention, in a method for cooling window foils stated above, the center of said primary window foil is supported by means of a center support disposed within a scanning tube of said accelerator, wherein said reversal of said cooling gasses is effected by the use of the bending of said primary window foil and by the shape of the distal end of said center support.

According to a further aspect of the invention, in a method for cooling window foils stated above, said primary window foil is attached to the outlet of said scanning tube by means of a foil mounting flange, and said bending of said primary window foil is held by positioning the distal end of said central support at a position flush with or projecting to the atmospheric side from the end surface of said window foil mounting flange.

According to a still further aspect of the invention, there is provided an apparatus for cooling window foils for extracting electron beams from a scanning type electron beam accelerator including a scanning tube, a primary window foil of double window type attached to the outlet of said scanning tube, a secondary window foil positioned on the atmospheric side of said primary window foil, a flange for attaching said primary window foil to said outlet of said scanning tube, a center support provided within said scanning tube for supporting said primary window foil, and cooling gasses blowing out slits for supplying cooling gasses to the surface of said window foils, characterized in that said cooling gasses blowing out slits are provided along both sides of said primary window foil in opposition to each other so that said cooling gasses are reversed at the center of said primary window foil.

According to a further aspect of the invention, in an apparatus for cooling window foils stated above, said primary window foil is attached to said outlet of said scanning tube by means of a window mounting flange, and the distal end of said center support is positioned at a position flush with or projecting to the atmospheric side from the end surface of said window foil mounting flange.

According to a further aspect of the invention, in an apparatus for cooling window foils stated above, suction ducts for recovering said cooling gasses are provided along both sides of said secondary window foil in opposition to each other.

According to a further aspect of the invention, in an apparatus for cooling window foils stated above, said center support includes a cooling water passage near and along the distal end thereof.

According to a still further aspect of the invention, in an apparatus for cooling window foils stated above, an outer periphery of said primary window foil is held against said window mounting flange by means of a holding plate.

According to the present invention, the drawback of the prior art can be overcome by uniformly reversing the cooling gasses to the right side and the left side by a simple mechanism. That is, in the conventional one-side-blowing out system, when the length of a window portion is increased in the short axis direction thereof to increase the travelling distance of electron beams and accordingly the width of the window is increased, cooling gasses do not reach the second window of a primary window foil and thus cooling cannot be sufficiently carried out unless the amount of the gasses is increased by increasing the slit width of a duct. Whereas, in the present invention, the employment of the both-side-blowing-out system permits both the windows of the primary window foil to be effectively cooled without increasing the amount of the cooling gasses.

Further, different from the conventional both-side-blowing-out cooling method, the reversing mechanism is formed by a part of the central support. Namely, the position of the distal end of the central support is projected to the atmospheric side and the shape of the distal end as the reversing mechanism for cooling gasses is formed to optimally reverse the cooling gasses and avoid the impingement of dispersed electron beams as much as possible. This is different from the conventional method of mounting the separate reversing mechanism to the central support located in the vacuum from the atmosphere side. Thus, the window foils can be cooled without deforming the reversing mechanism by thermal expansion and heating and the damaging to the foils can be positively avoided. In addition, since the secondary window foil is simultaneously cooled by the reversed cooling gasses, the primary and secondary window foils can be simultaneously cooled without the need of large equipment as compared with the conventional method.

The above and other objects, features and advantages of the present invention will become more apparent from the following description when taken in conjunction with the accompanying drawings in which a preferred embodiment of the present invention is shown by way of illustrative examples.

PREFERRED EMBODIMENT OF THE INVENTION

Figure 1:
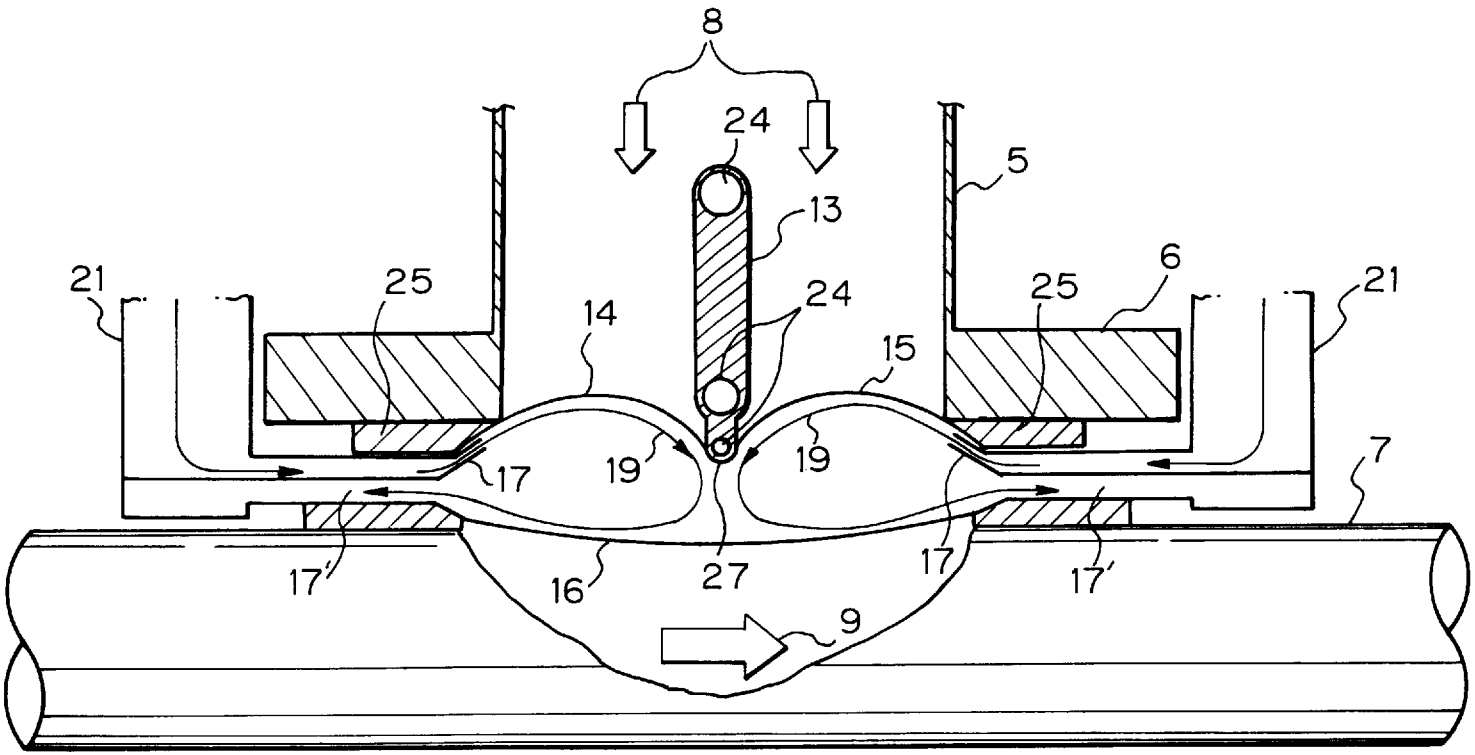
FIG. 1 is a view showing an entire arrangement of an apparatus according to an embodiment of the invention and for explaining a cooling method of the present invention.

A preferred embodiment of the present invention will be described below referring to the drawings.

Figure 2:
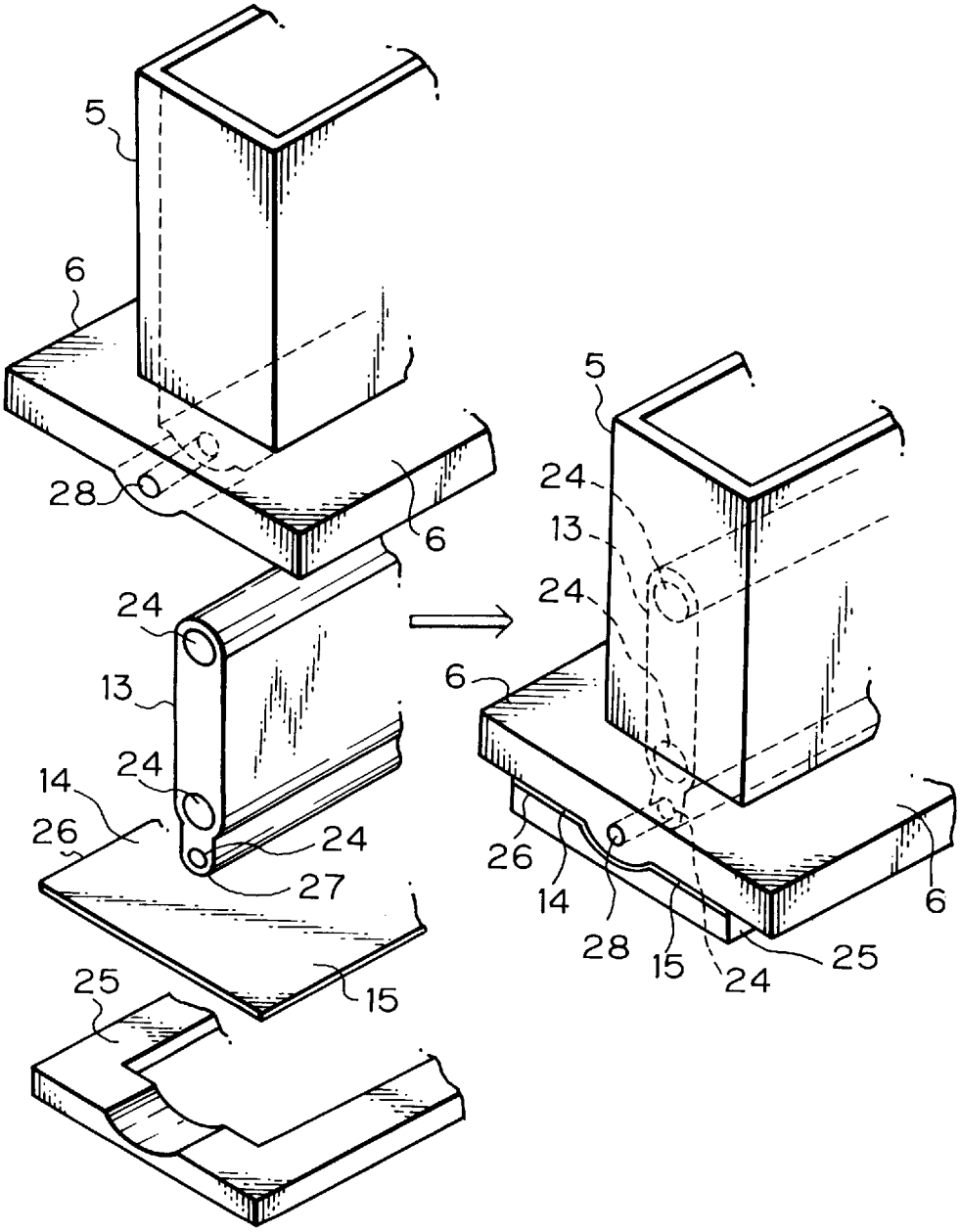
FIG. 2 is a perspective view for showing an assembly of a window foil of the present invention.
Figure 3:
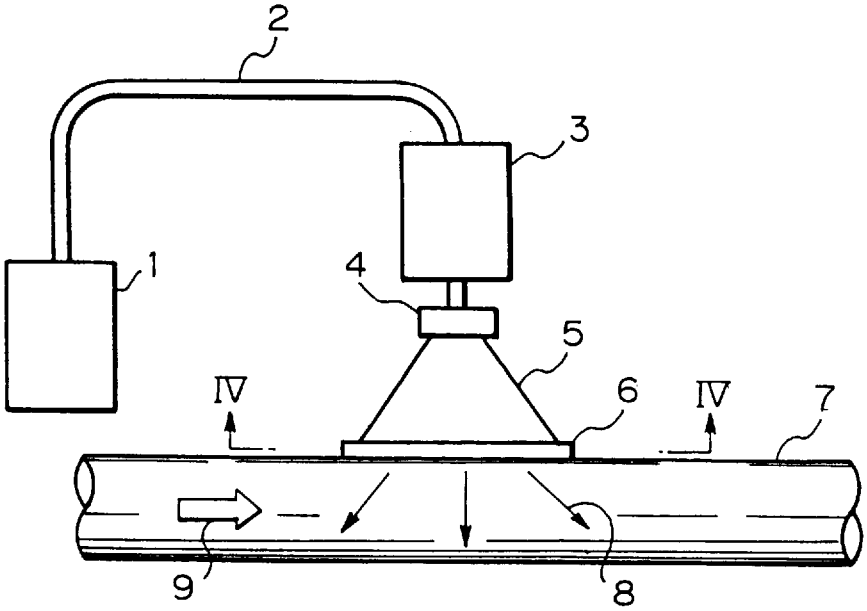
Fig. 3 PRIOR ART
FIG. 3 is a view showing the arrangement of a conventional electron beam accelerator.
Figure 4:
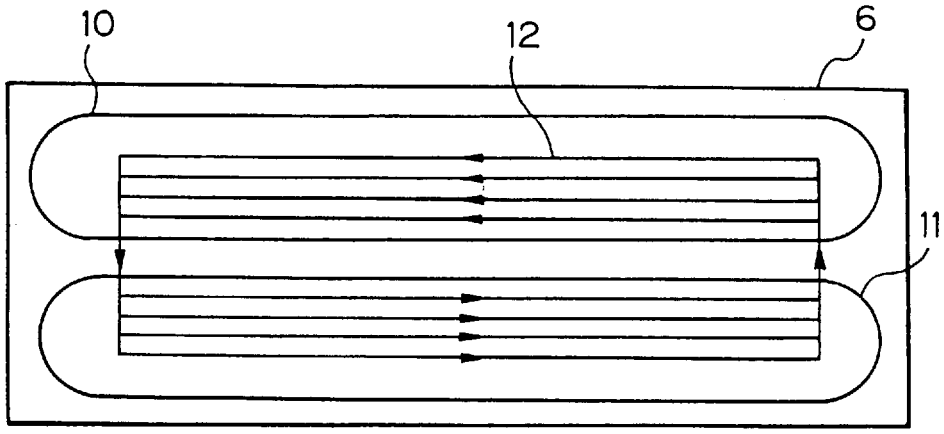
Fig. 4 PRIOR ART
FIG. 4 is a view taken along line IV—IV in FIG. 3 and for explaining the structure of double windows.
Figure 5:
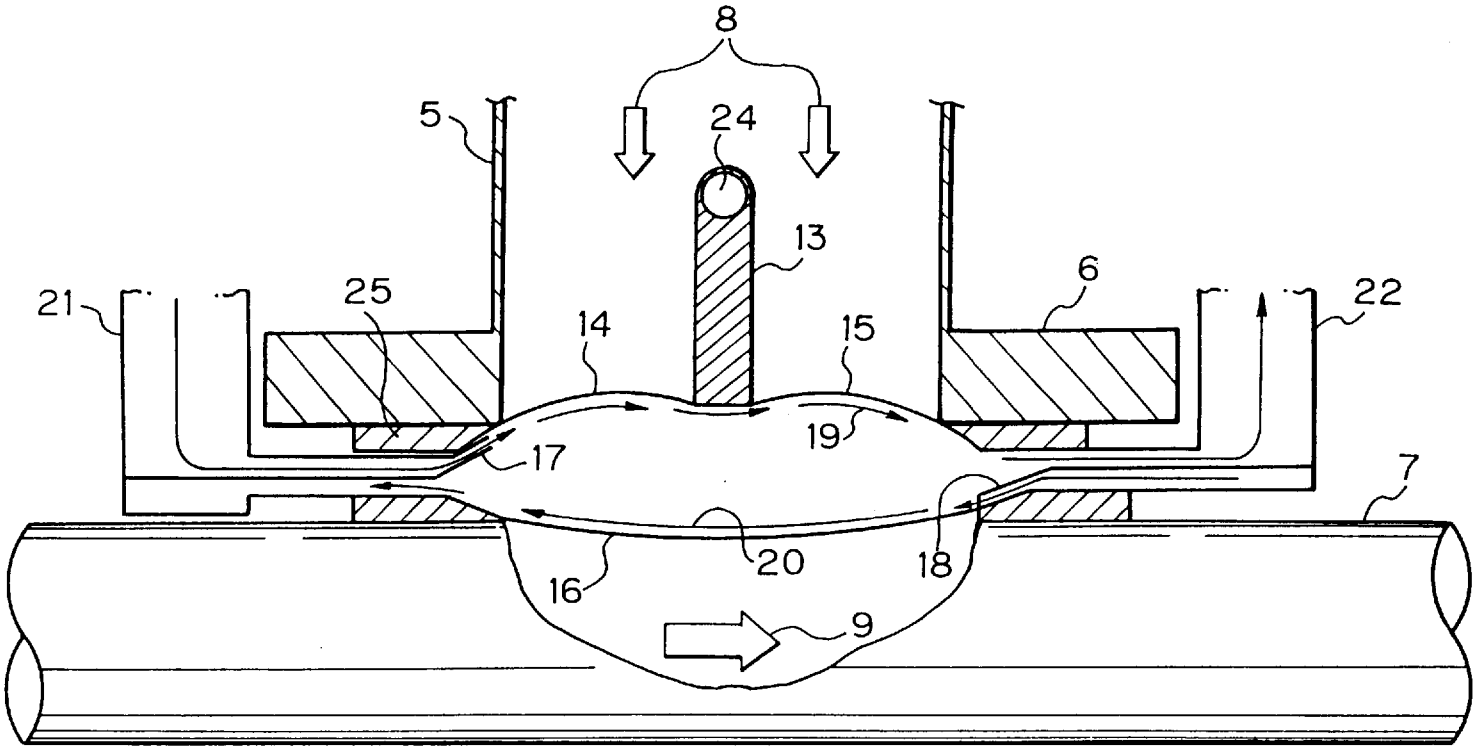
FIG. 5 is a view showing an entire arrangement for explaining a conventional cooling method.
Figure 6:
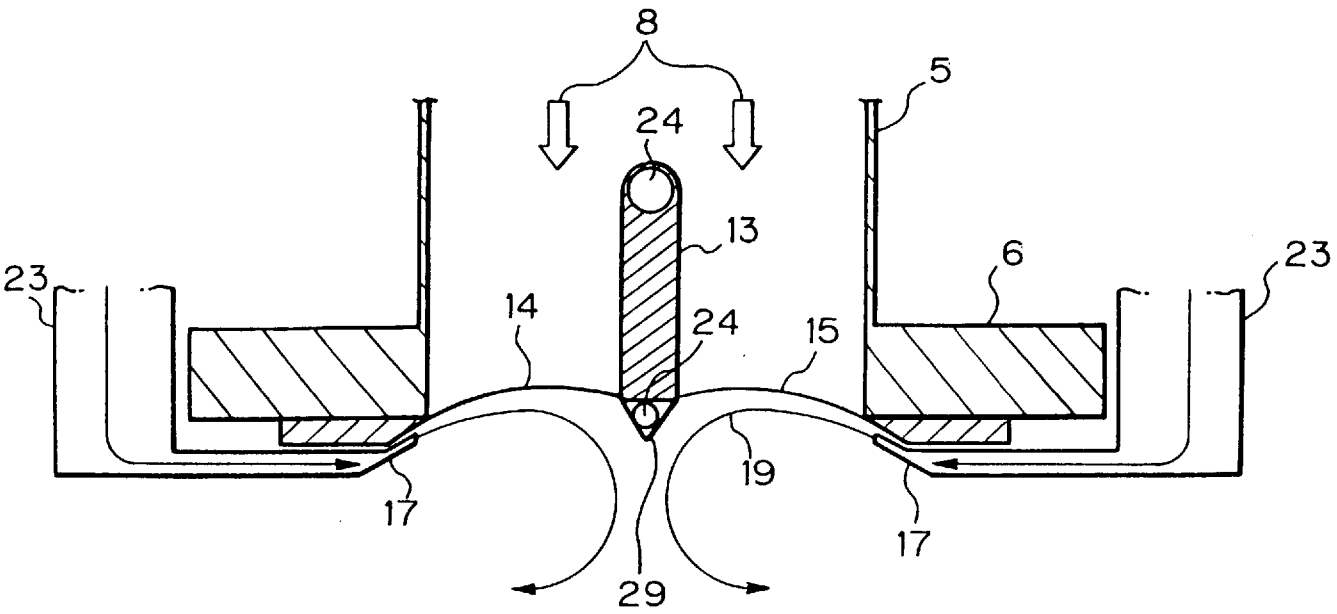
Fig. 6 PRIOR ART
FIG. 6 is a view showing an entire arrangement for explaining another conventional cooling method in which no secondary window foil is adopted.

FIG. 1 is a view showing an overall arrangement for explaining a window foil cooling method of the present invention and FIG. 2 shows a perspective view for explaining an assembly of the window foil.

In FIG. 1, the reference numeral 5 denotes a scanning tube for electron beams, 6 a flange for mounting a window foil to the lower end of the scanning tube and integrally formed therewith, 7 an exhaust gas duct, 8 electron beams, 9 an exhaust gas flow, 13 a central support provided within the scanning tube for supporting the central portion of the width of the primary window foil, 14 a first window of the primary window foil, 15 a second window of the primary window foil, 16 a secondary window foil provided on the atmospheric side of the primary window foil, 17 a blowing out duct slit for supplying cooling gasses to the surface of the window foils of the primary window foil, 17' a suction duct for recovering the cooling gasses, 19 a flow of the cooling gasses, 21 suction/blowing out duct, 24 cooling water passages provided in the central support 13 along the longitudinal direction thereof, 27 the distal end of the central support 13 which is positioned so that it is flush with or projecting to the atmospheric side from the end surface or lower surface of the foil mounting flange 6.

In FIG. 2, the reference numeral 6 denotes the window foil mounting flange, 25 a foil holding plate, 26 a primary window foil, 27 the distal end of the central support 13, and 28 a cooling medium supply port.

In this invention, as shown in the drawings, the distal end 27 of the central support 13 is positioned so that it is flush with or projecting to the atmospheric side from the end surface of the foil mounting flange 6, the cooling gasses blowing out slits 17, 17 are disposed along the longitudinal sides of the primary window foil so that they are opposed to each other, and the cooling air recovering ducts 17', 17' are disposed along the longitudinal sides of the secondary window foil 16 so that they are opposed to each other.

Next, operation of the present invention will be described referring to FIG. 1. The cooling gasses 19 fed from the ducts 21, respectively to cool the primary window foil are blown against the first and second windows 14, 15 of the primary window foil from the blowing out slits 17, 17, respectively. The thus blown cooling gasses 19 flow along the surfaces of the foils bent by the pressure difference between vacuum and atmospheric pressure to thereby cool the first and second windows 14, 15 of the primary window foil, respectively. Thereafter, the cooling gasses impinge on the distal end 27 of the central support 13 which is flush with or projecting from the end surface of the window foil mounting flange 6 to the atmospheric side and are then reversed diagonally and downwardly interfering with each other while changing their flow directions. They then impinge on the secondary window foil 16, flowing along the surface thereof and are introduced to the opposing suction ducts 17', 17' while cooling the secondary window foil 16.

Incidentally, when the distal end of the central support is projected to the atmospheric side from the end surface of the window foil mounting flange, if the projecting length is within 3% of the length of the short axis of the primary window portion, then, the stress applied to the primary window foil can be restrained in a relatively small range and it is preferable.

As described above, by blowing out the cooling gasses 19 from the blowing out slits 17, 17 provided on opposite sides of the primary window foil so as to oppose each other and by reversing the flow of the cooling gasses at the central area of the primary window foil, it is possible to evenly impinge and cool the first window 14 and the second window 15 of the primary window foil which is bent by the pressure difference between the vacuum and the atmospheric pressure, and thereby enabling effective cooling of the primary window foil despite increasing of the length of the short axis or width of the primary window foil. Also, since the reversing mechanism of the cooling gasses 19 is formed by a part of the central support 13, i.e. the distal end 27 of the central support, even if the dispersed electron beams impinge the reversing mechanism, the deformation of the reversing mechanism is relatively small. Thus, there is no danger of disturbing the flow of the cooling gasses and damaging the window foil. In addition, it is possible to simultaneously cool the secondary window foil 16 by means of the reversed cooling gasses.

Incidentally, reversal of the cooling gasses at the central area of the primary window foil may be effected even if the distal end 27 of the central support 13 is positioned so that it is slightly retracted to the vacuum side from the end surface of the foil mounting flange 6.

This reversal of flow of the cooling gasses can be realized by adjusting the distance between the primary window foil and the secondary window foil and the widths of the slits of the cooling gas blowing slits and further the projecting distance of the central support to the atmospheric side. In addition, as shown in FIG. 1, the ratio at which the electron beams dispersed by the primary window foil impinge on the central support can be reduced by changing the shape of the distal end of the central support. Incidentally, as shown in FIG. 2, by causing the shape of the flange 6 and the window foil holding plate 25 to correspond to the shape of the distal end 27 of the central support projecting to the atmosphere side, the primary window foil can be mounted on the flange 6 with bending thereof being prevented at the end portions of the flange and thereby maintain positive gas-tightness. As described above, since the double windows of the primary window foil can be uniformly cooled and further the secondary window can be also cooled simultaneously, damage to the window foils, in particular, damage to the double windows of the primary window foil can be prevented.

As described above, according to the present invention, the employment of the both-side-blowing-out system permits both the windows of the primary window foil to be effectively cooled without increasing the amount of the cooling gasses.

Further, the window foils can be cooled without deforming the reversing mechanism by thermal expansion and heating and the damaging to the foils can be positively avoided. In addition, since the secondary window foil is simultaneously cooled by the reversed cooling gasses, the primary and secondary window foils can be simultaneously cooled without the need of large equipment as compared with the conventional method.

What is claimed is:

1. A method for cooling window foils for extracting electron beams from a scanning type electron beam accelerator including a scanning tube, a primary window foil of double window type attached to the outlet of said scanning tube, and a secondary window foil positioned on an atmospheric side of said primary window foil, said method comprising the steps of:

blowing cooling gasses against an electron beam scanning surface from both sides thereof to cool said primary window foil;

reversing the flow of said cooling gasses at the center of said primary window foil; and circulating said cooling gasses by sucking said cooling gasses from both sides of said electron beam scanning surface to thereby simultaneously cool said secondary window foil.

2. A method for cooling window foils of claim 1, wherein the center of said primary window foil is supported by means of a center support disposed within a scanning tube of said accelerator, wherein said reversal of said cooling gasses is effected by use of a bending of said primary window foil and by the shape of a distal end of said center support contacting said primary window foil.

3. A method for cooling window foils of claim 2, wherein said primary window foil is attached to the outlet of said scanning tube by means of a foil mounting flange, and said bending of said primary window foil is held by positioning the distal end of said central support at a position flush with or projecting to the atmospheric side from the end surface of said window foil mounting flange.

4. An apparatus for cooling window foils which extract electron beams from a scanning type electron beam accelerator, said apparatus comprising:

a scanning tube;

a primary window foil of double window type;

a flange for attaching said primary window foil to an outlet of said scanning tube;

a center support provided within said scanning tube for supporting said primary window foil;

a secondary window foil positioned opposite an atmospheric side of said primary window foil; and slits for supplying cooling gasses to the surface of said window foils, wherein said cooling gasses blowing out said slits are provided along both sides of said primary window foil in opposition to each other and are reversed at the center of said primary window foil, simultaneously cooling both of said window foils.

5. An apparatus for cooling window foils claimed in claim 4, wherein said primary window foil is attached to said outlet of said scanning tube by means of a window mounting flange, and a distal end of said center support contacting said primary window foil is positioned at a position flush with or projecting to an atmospheric side from end surface of said window foil mounting flange.

6. An apparatus for cooling window foils claimed in claim 4, wherein suction ducts for recovering said cooling gasses are provided along both sides of said secondary window foil in opposition to each other.

7. An apparatus for cooling window foils claimed in claim 5 or 6, wherein said center support includes a cooling water passage near and along the distal end thereof.

8. An apparatus for cooling window foils claimed in any one of claims 4 to 6, wherein an outer periphery of said primary window foil is held against said window mounting flange by means of a holding plate.

9. An apparatus for cooling window foils claimed in claim 7, wherein an outer periphery of said primary window foil is held against said window mounting flange by means of a holding plate.

* * * * *